US009386815B2

(12) United States Patent
Miller

(10) Patent No.: US 9,386,815 B2
(45) Date of Patent: Jul. 12, 2016

(54) MULTI-FUNCTION GLOVE

(71) Applicant: Daniel L. Miller, Lancaster, CA (US)

(72) Inventor: Daniel L. Miller, Lancaster, CA (US)

( * ) Notice: Subject to any disclaimer, the term of this patent is extended or adjusted under 35 U.S.C. 154(b) by 463 days.

(21) Appl. No.: 13/875,848

(22) Filed: May 2, 2013

(65) Prior Publication Data

US 2014/0325739 A1 Nov. 6, 2014

(51) Int. Cl.
*A41D 19/00* (2006.01)

(52) U.S. Cl.
CPC ..... *A41D 19/0024* (2013.01)

(58) Field of Classification Search
CPC ..... A41D 19/0024
USPC ..... 2/160, 161.1, 161.6
See application file for complete search history.

(56) References Cited

U.S. PATENT DOCUMENTS 4,805,242 A 2/1989 Bolton
4,862,521 A 9/1989 Mann
5,003,637 A 4/1991 Lonon
D675,398 S 2/2013 Miller
2010/0251457 A1* 10/2010 Lattimer ..... A41D 19/002 2/160
2011/0072552 A1* 3/2011 Johnson ..... A41D 19/002 2/160
2011/0099687 A1* 5/2011 Skrocki ..... A41D 19/01523 2/161.1
2012/0167273 A1* 7/2012 Ballinger ..... A41D 19/0037 2/160

* cited by examiner

*Primary Examiner* — Katherine Moran
(74) *Attorney, Agent, or Firm* — Albert O. Cota

(57) ABSTRACT

A multi-function glove that has attached a wrist band, a little finger sheath, a ring finger sheath and a truncated sheath that fits into a middle finger, an index finger and the thumb. The glove has attached a side-hinged viewing flap that covers a paper pad such as a POST-IT® paper pad. The glove also has attached a zippered pocket that extends vertically from the little finger sheath to the wrist band. The pocket is dimensioned to conveniently store and remove a writing implement. The middle finger, index finger and thumb projecting from the truncated cavities allow the writing implement to be easily grasped and maneuvered.

17 Claims, 4 Drawing Sheets

MULTI-FUNCTION GLOVE

TECHNICAL FIELD

The invention generally pertains to gloves, and more particularly to a multi-function glove that includes a sheath covered little finger and ring finger, and a truncated sheath that covers the middle finger, the index finger and the thumb. The glove also includes a pocket for holding a writing implement, and a viewing flap that encloses a paper pad.

BACKGROUND ART

A glove is a garment that covers the whole hand having separate sheaths or openings for each finger and the thumb. Gloves that have an opening but no sheath for each finger are called "fingerless gloves". Fingerless gloves having one large opening rather than individual openings for each finger are called gauntlets. Gloves which cover the entire hand or fist but do not have separate finger openings or sheaths are called mittens. A hybrid of a glove and a mitten contains open-ended sheaths for the four fingers but not the thumb. Lastly, disposable gloves are often used by individuals such as health care professionals for hygiene and contamination protection measures.

Prior art gloves have provided protection and comfort to hands against cold or heat, damage by friction, abrasions or chemicals, and disease. Generally, gloves provide a guard for what a bare hand should not touch. In contrast, the inventive multi-function glove not only functions as a protective glove, but also has attached a writing implement, a paper pad and a combination of truncated sheaths that expose the middle and index fingers and the thumb. The exposed fingers and thumb allow a person to easily grasp and maneuver the writing implement.

A search of the prior art did not disclose any literature or patents that read directly on the claims of the instant invention. However, the following U.S. patents are considered related:

| PAT. NO. | INVENTOR | ISSUED |
|---|---|---|
| D675,398 | Miller | 5 Feb. 2013 |
| 5,003,637 | Lonon | 2 Apr. 1991 |
| 4,862,521 | Mann | 5 Sep. 1989 |
| 4,805,242 | Bolton | 21 Feb. 1989 |

The D675,398 patent discloses a multi-function glove having five finger sheaths, a zippered pocket that contains a writing implement and a viewing flap having a transparent window that interfaces with a paper pad. The inventor of this patent is also the inventor of the instant application which includes several improvements.

The U.S. Pat. No. 5,003,637 patent discloses a glove having a back surface to which is attached a utility device that includes a driver's license, credit cards, pencils and the like.

The U.S. Pat. No. 4,862,521 patent discloses a glove having a pocket attached thereto. The pocket is dimensioned to retain and protect a timepiece that can be viewed through a transparent window located on the pocket.

The U.S. Pat. No. 4,805,242 patent discloses a pocket for holding a packet of dispensable paper tissues. The pocket is configured to be attached to a glove or other like articles of clothing.

DISCLOSURE OF THE INVENTION

The multi-mode glove is designed to provide a user of the glove with convenient and easy access to a writing implement and to a memo pad, both of which are attached to the glove. In its basic design configuration the multi-function glove is comprised of:

A. An outer cover attached to an inner cover to form a glove enclosure having an upper end and a lower end. The upper end has attached a little finger sheath, a ring finger sheath, a middle finger truncated sheath, an index finger truncated sheath, a thumb truncated sheath, and a wrist band attached around the outer and inner covers.

B. A pocket dimensioned to enclose a writing implement. The pocket has an upper end located adjacent the little finger sheath, and a lower end located adjacent the wrist band.

C. A viewing flap comprising:

(1) A lower section having a perimeter border attached to the outer cover of the glove. The perimeter border has an inner side, an outer side, an upper side and a lower side, wherein the four sides enclose an opening, and the inner side of the perimeter border has a first attachment means.

(2) An upper section having a perimeter border having an inner side, an outer side, an upper side and a lower side. The outer side of the upper section is hingedly attached to the outer side of the lower section. The four sides enclose an opening that coincides with the opening on the inner section. The inner side of the perimeter border has a second attachment means that interfaces with the first attachment means located on the inner section which allows the lower section to be secured to the upper section.

(3) A transparent material attached to the edges of the opening on the upper section of the viewing flap, and D. A paper pad removably attached to the outer cover of the glove into the opening on the lower section.

The viewing flap attachment means preferably consists of a set of hook and loop fasteners. When the fasteners interface a hollow area is formed between the upper and lower sections of the viewing flap.

A zipper is utilized to facilitate the insertion and removal of the writing implement from the pocket. Attached to the lower end of the pocket is a pointed cavity that is dimensioned to receive the pointed end of the writing implement. The cavity is especially important to collect any ink that may leak from a ball-point pen.

In view of the above disclosure, the primary object of the invention is to produce a multi-function glove that provides a convenient and accessible writing implement and a paper pad. The glove also exposes the middle finger, the index finger and the thumb to allow a person to easily grasp and maneuver the writing implement.

In addition to the primary object of the invention it is also an object of the invention to provide an invention that:

can be made in various sizes,
can be made of various materials and colors,
can be helpful to many individuals in various occupations,
is durable and long-lasting,
is easily cleaned and maintained,
can be used by both men and women, adults and children, and
is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 2:
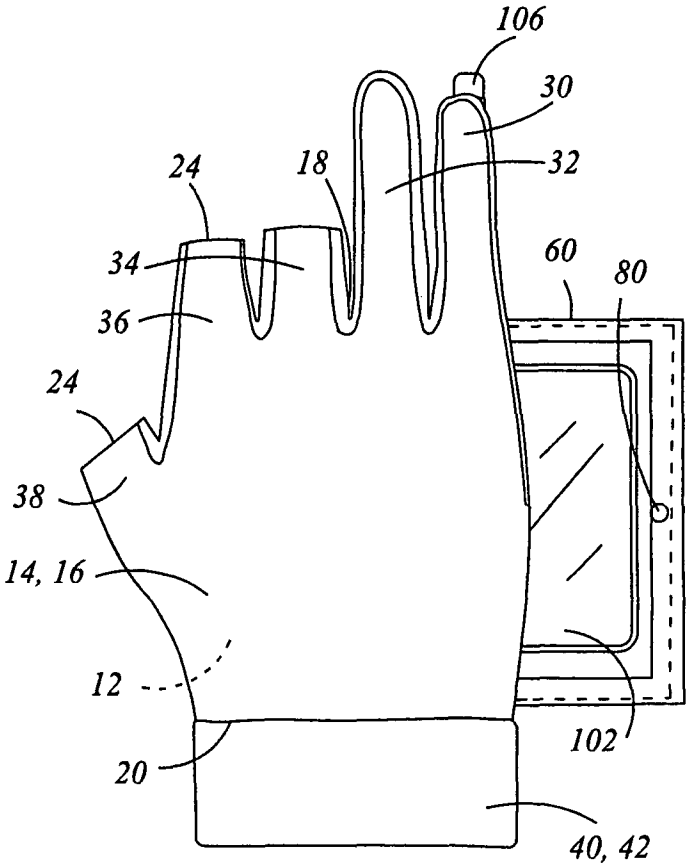
FIG. 2 is an elevational view showing the inner surface of the glove with a portion of an opened viewing flap extending from the edge of the glove.
Figure 1:
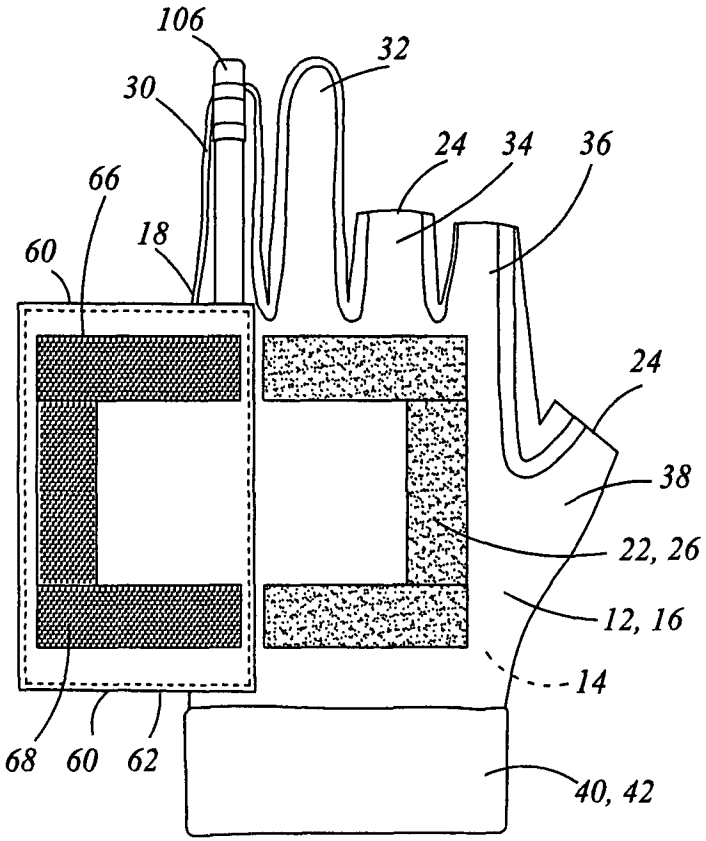
FIG. 1 is an elevational view showing the outer surface of a left-handed glove having attached the hook section of a hook and loop fastener, and an inner surface of a viewing flap having attached the loop section of the hook and loop fastener. When the hook and loop sections interface the inner surface of the viewing flap is attached to the outer surface of the glove.

The best mode for carrying out the invention is presented in terms that disclose a preferred embodiment of a multi-function glove 10 which is shown and described as a glove that is worn on the left hand when a person is right-handed. This allows a person to basically utilize the functionally of the glove with their dominant right-hand. However, a right-handed glove 10 that is worn by a left-handed person is a mirror image of the left-handed multi-function glove 10. The preferred embodiment of the multi-function glove 10, as shown in FIGS. 1-9, is comprised of the following inventive elements: an outer cover 12, an inner cover 14, a wrist band 40, a zippered pocket 44 and a viewing flap 60. The inventive elements function in combination with a paper pad 104 and a writing implement 106.

Figure 4:
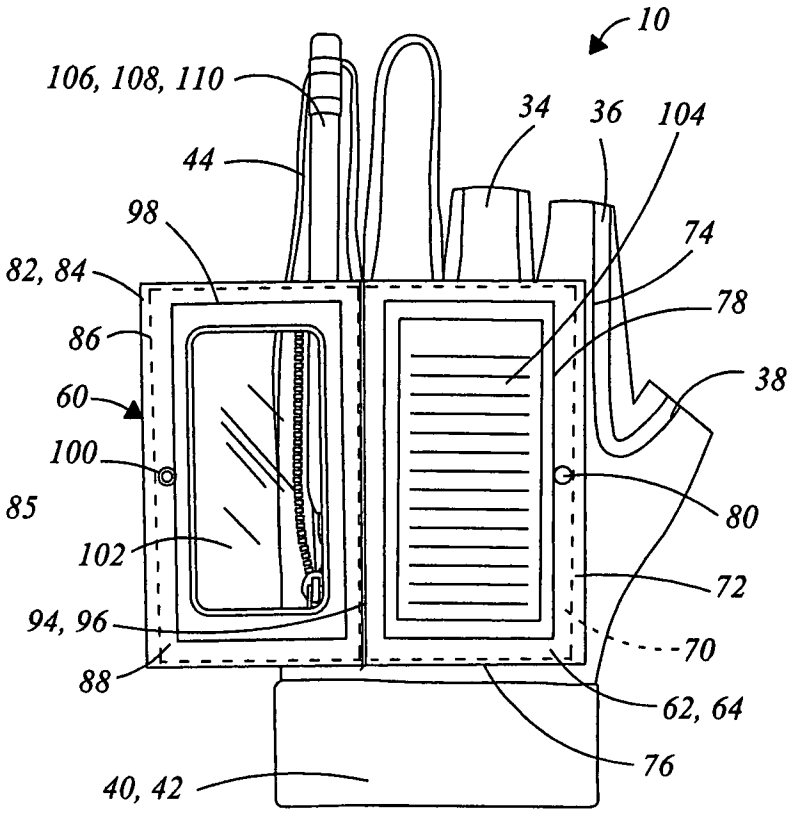
FIG. 4 is an elevational view showing the outer surface of the glove with the viewing flap shown in an open position.
Figure 3:
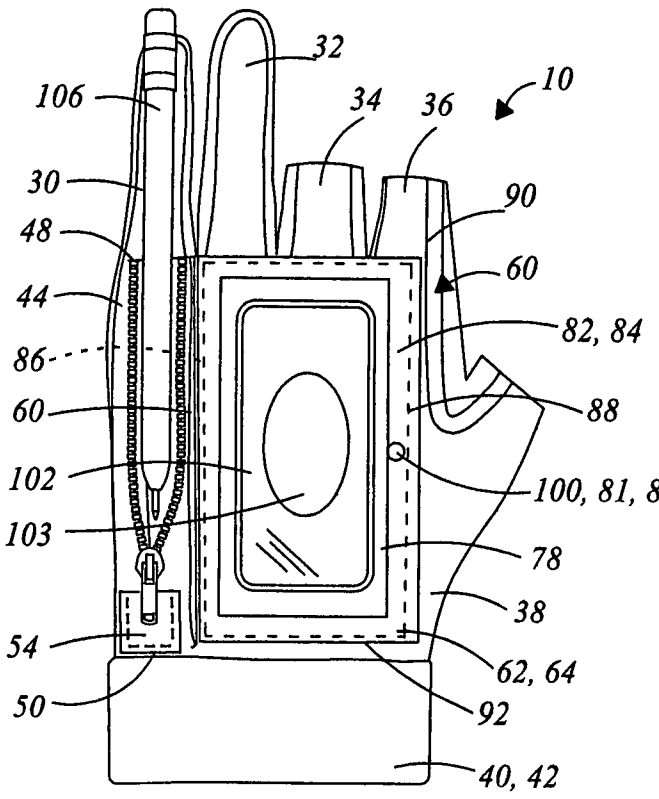
FIG. 3 is an elevational view showing the outer surface of the glove with the viewing flap closed and a writing implement inserted into an opened zippered pocket.
Figure 6:
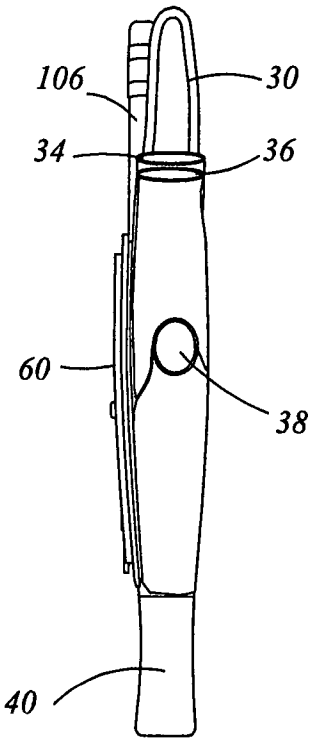
FIG. 6 is an elevational right side view of the multi-function glove.
Figure 7:
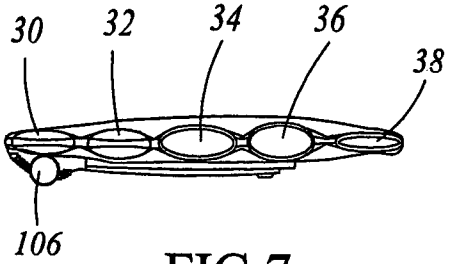
FIG. 7 is an elevational front view of the multi-function glove.
Figure 8:
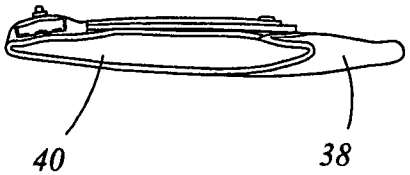
FIG. 8 is an elevational rear view of the multi-function glove.
Figure 5:
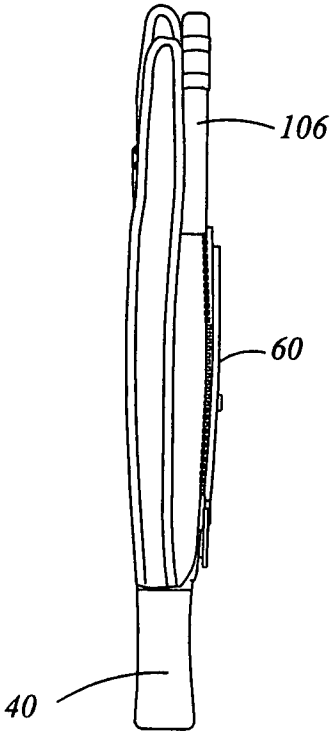
FIG. 5 is an elevational left side view of the multi-function glove.
Figure 9:
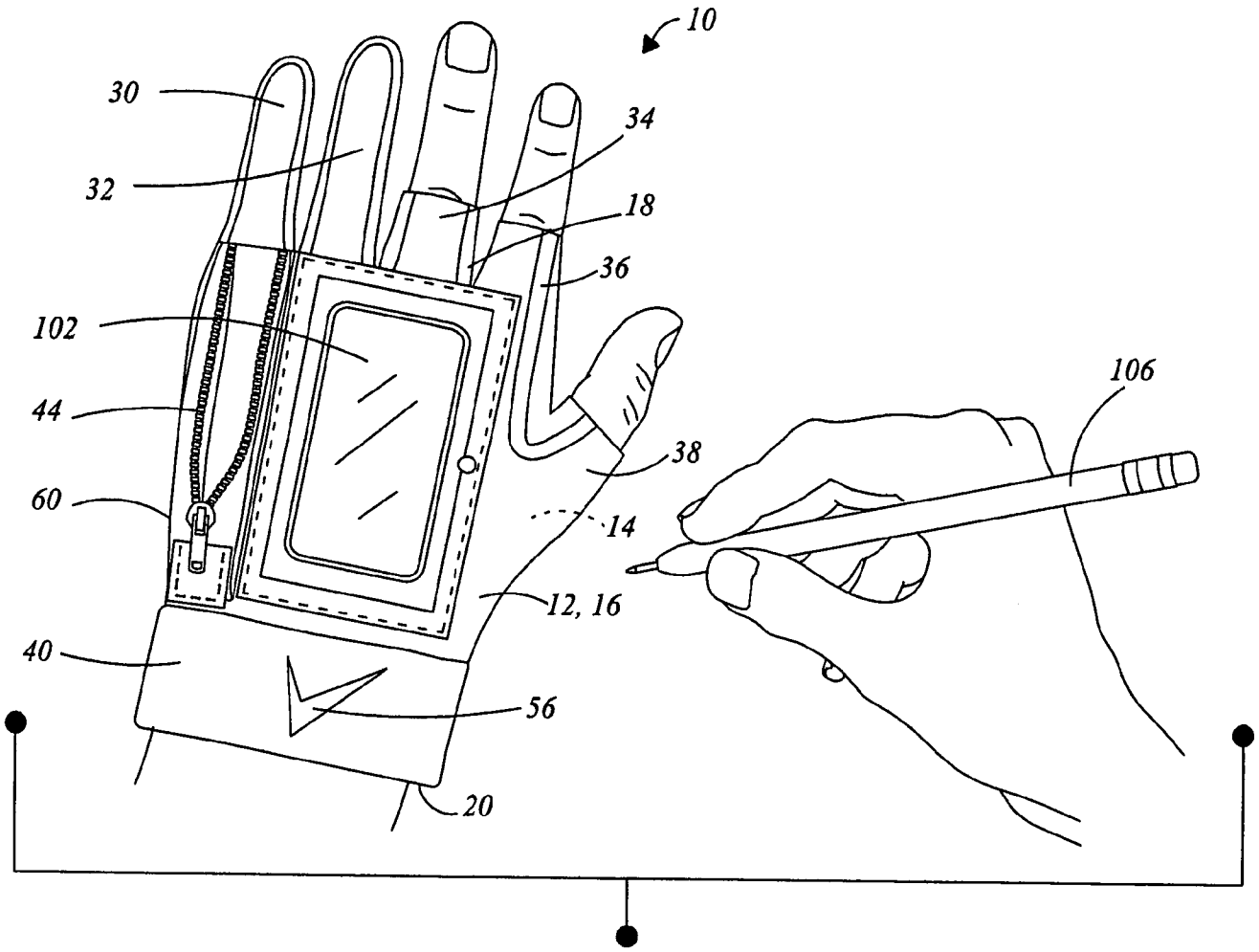
FIG. 9 is an elevational view showing a writing implement removed from the zippered pocket and held by a person's hand.

The outer cover 12 is integrally attached to the inner cover 14 to form a glove enclosure 16 having an upper end 18 and a lower end 20. The outer cover 12, as shown in FIGS. 3 and 4, also has attached the hook section 22 of a hook and loop fastener 26. The upper end 18 of the enclosure 16 has attached a little finger sheath 30, a ring finger sheath 32, a middle finger truncated sheath 34, an index finger truncated sheath 36, and a thumb truncated sheath 38. The fingers protruding from the truncated sheaths 32,34,36 provide a user of the glove 10 with the necessary dexterity to properly grasp and utilize the writing implement 106. The truncated sheaths are stitched at their outer edges to prevent the material from unraveling. The wrist band 40, which is attached to the lower end 20 of the outer and inner covers 12,14 is made of a resilient material 42 to maintain the glove 10 secured to a person's wrist. The elements comprising the glove enclosure 16 are made of a material selected from the group consisting of a polyamide, cotton, rayon and a knitted fabric. The polyamide is also referred to by its trademark NYLON®.

The zippered pocket 44 is dimensioned to enclose a writing implement 106 such as a ball-point pen 108 or a pencil 110 that is no longer than the length of the zipper 46. The zippered pocket 44 has an upper end 48 that is located adjacent the little finger sheath 30, and a lower end 50 that is located adjacent the wrist band 40. At the lower end 50 of the zippered pocket 44 is attached by an attachment means 52 a molded pointed cavity 54. A molded pointed cavity 54 is attached at the lower end 50 of the zippered pocket 44 by an attachment means 52. The cavity 54 dimensioned to receive the pointed end of the writing implement 106 to prevent any leakage from a ball-point pen 108 from soiling the glove 10 and to prevent the lower end 50 of the zippered pocket 44 from tearing. The zipper 46 of the zippered pocket 44 is preferably made of plastic and the molded pointed cavity 54 is made of plastic, metal such as aluminum, or a reinforced material. The attachment means 52 for attaching the cavity 54 is comprised of an adhesive or stitching.

The viewing flap 60, as shown best in FIGS. 3 and 4, is comprised of a lower section 62, an upper section 82 and a transparent material 102. The lower section 62 has a perimeter border 64 that has attached a loop section 66 of a hook and loop fastener 68 which allows the lower section 62 to be attached to the hook section 22 located on the outer cover 12 of the glove 10. The perimeter border 64 has an inner side 70, an outer side 72, an upper side 74 and a lower side 76. The four sides enclose an opening 78 and the inner side 70 of the perimeter border 64 has attached a first attachment means 80.

The upper section 82 has a perimeter border 84 having an inner side 86, an outer side 88, an upper side 90 and a lower side 92. The outer side 88 of the upper section 82 is hingedly attached by a first attachment means 94 that preferably consists of a living lunge 96. The four sides 86-92 enclose an opening 98 that coincides with the opening 78 on the lower section 62. The inner side 86 of the perimeter border 84 has a second attachment means 100 that interfaces with the first attachment means 80 located on the lower section 62 to allow the lower section 62 to be secured to the upper section 82. The first and second attachment means 80 and 100 can consist of a pair of detents 81, a set of magnets 83 or a hook and loop fastener 85.

To complete the viewing flap 60, a transparent material 102 and a paper pad 104 is utilized. The transparent material 102 is attached to the edges of the opening 98 on the upper section 82 of the viewing flap 60. The material used for the transparent material is preferably comprised of clear celluloid. As an "option", the transparent material 102 can include a substantially centered opening 103 that allows a mark to be placed on the paper pad 104 without opening the viewing flap 60. Additionally, the centered opening 103 allows a card(s) to be slid out of the viewing flap 60 with a nudge of a finger or the like. The paper pad 104, which can consist of a POST-IT® and is removably attached to the outer cover 12 of the glove 10 into the opening on the lower section 62. Also, indicia 56 can be applied to selected areas of the multi-function glove 10.

While the invention has been described in detail and pictorially shown in the accompanying drawings it is not to be limited to such details, since many changes and modification may be made to the invention without departing from the spirit and the scope thereof. Hence, it is described to cover any and all modifications and forms which may come within the language and scope of the claims.

The invention claimed is:

1. A multi-function glove comprising:

a) an outer cover attached to an inner cover to form a glove enclosure having an upper end and a lower end, wherein the upper end has attached a little finger sheath, a ring finger sheath, a middle finger truncated sheath, an index finger truncated sheath, a thumb truncated sheath, and a wrist band attached around the outer and inner covers, b) a pocket dimensioned to enclose a writing implement, said pocket having an upper end located adjacent the little finger sheath, and a lower end located adjacent the wrist band, c) a viewing flap comprising:

(1) a lower section having a perimeter border attached to the outer cover of said glove, wherein the perimeter border has an inner side, an outer side, an upper side and a lower side, wherein the four sides enclose an opening, and the inner side of the perimeter border has a first attachment means, (2) an upper section having a perimeter border having an inner side, an outer side, an upper side and a lower side, wherein the outer side of the upper section is hingedly attached to the outer side of the lower section, wherein with the four sides enclose an opening that coincides with the opening on the inner section, wherein the inner side of the perimeter border has a second attachment means that interfaces with the first attachment means on the inner section which allows the lower section to be secured to the upper section, (3) a transparent material attached to the opening on the upper section of said viewing flap, and d) a paper pad removably attached to the outer cover of said glove into the opening on the lower section.

2. The multi-function glove as specified in claim 1 wherein said glove is made of a material selected from the group consisting of a polyamide, cotton, rayon and a knitted fabric.

3. The multi-function glove as specified in claim 1 wherein the said pocket further comprises a zipper.

4. The multi-function glove as specified in claim 1 wherein the first and second viewing flap attachment means are selected from the group consisting of a pair of detents, a set of magnets and a hook and loop fasteners.

5. A multi-function glove comprising:

a) an outer cover integrally attached to an inner cover to form a glove enclosure having an upper end and a lower end, wherein the outer cover has attached a hook section of a hook and loop fastener, and the upper end has attached a little finger sheath, a ring finger sheath, a middle finger truncated sheath, an index finger truncated sheath, a thumb truncated sheath, and a wrist band attached to the lower end of the outer and inner covers, b) a zippered pocket dimensioned to enclose a writing implement, wherein said zippered pocket has an upper end located adjacent the little finger sheath, and a lower end located adjacent the wrist band, wherein a molded pointed cavity is attached at the lower end of the zippered pocket by an attachment means, c) a viewing flap comprising:

(1) a lower section having a perimeter border that has attached a loop section of a hook and loop fastener which allows the lower section to be attached to the hook section located on the outer cover of said glove, wherein the perimeter border has an inner side, an outer side, an upper side and a lower side, wherein the four sides enclose an opening, and the inner side of the perimeter border has attached a first attachment means, (2) an upper section having a perimeter border having an inner side, an outer side, an upper side and a lower side, wherein the outer side of the upper section is hingedly attached by an attachment means to the outer side of the lower section, and with the four sides enclose an opening that coincides with the opening on the lower section, wherein the inner side of the perimeter border has a second attachment means that interfaces with the first attachment means on the lower section to allow the lower section to be secured to the upper section, (3) a transparent material that is attached to the edges of the opening on the upper section of said viewing flap, and d) a paper pad removably attached to the outer cover of said glove into the opening on the lower section.

6. The multi-function glove as specified in claim 5 wherein said glove is made of a material selected from the group consisting of a polyamide, cotton, rayon and a knitted fabric.

7. The multi-function glove as specified in claim 5 wherein the wrist band is made of a resilient material.

8. The multi-function glove as specified in claim 5 wherein said means for hingedly attaching the outer side of the upper section to the outer sides of the lower securing comprises a living hinge.

9. The multi-function glove as specified in claim 5 wherein the zipper is comprised of plastic.

10. The multi-function glove as specified in claim 5 wherein the molded pointed cavity is made of plastic or a reinforced material.

11. The multi-function glove as specified in claim 10 wherein the attachment means for the molded pointed cavity is comprised of an adhesive or stitching.

12. The multi-function glove as specified in claim 5 wherein the first and second attachment means comprise a pair of detents.

13. The multi-function glove as specified in claim 5 wherein said first and second attachment means comprise a set of magnets.

14. The multi-function glove as specified in claim 5 wherein the first and second attachment means comprise a hook and loop fastener.

15. The multi-function glove as specified in claim 5 wherein the transparent material further having a substantially centered opening.

16. The multi-function glove as specified in claim 5 further comprising indicia.

17. The multi-function glove as specified in claim 5 wherein the truncated fingers are stitched at their outer edges to prevent the material from unraveling.

* * * * *